US011577255B2

(12) United States Patent
She et al.

(10) Patent No.: US 11,577,255 B2
(45) Date of Patent: Feb. 14, 2023

(54) MEAT GRINDER

(71) Applicant: DONGGUAN ZHEN ZHONG KANG PRECISION TRANSMISSION TECHNOLOGY CO., LTD, Dongguan (CN)

(72) Inventors: Yixin She, Dongguan (CN); Tangrong Ni, Dongguan (CN)

(73) Assignee: DONGGUAN ZHEN ZHONG KANG PRECISION TRANSMISSION TECHNOLOGY CO., LTD, Dongguan (CN)

( * ) Notice: Subject to any disclaimer, the term of this patent is extended or adjusted under 35 U.S.C. 154(b) by 218 days.

(21) Appl. No.: 17/117,409

(22) Filed: Dec. 10, 2020

(65) Prior Publication Data

US 2022/0143621 A1 May 12, 2022

(30) Foreign Application Priority Data

Nov. 9, 2020 (CN) ..... 202022570550.0

(51) Int. Cl.
*B02C 18/30* (2006.01)
*B02C 18/36* (2006.01)

(52) U.S. Cl.
CPC ..... *B02C 18/305* (2013.01); *B02C 18/302* (2013.01); *B02C 18/365* (2013.01); *B02C 2210/02* (2013.01)

(58) Field of Classification Search
CPC .... B02C 18/365; B02C 18/305; B02C 18/302
See application file for complete search history.

(56) References Cited

U.S. PATENT DOCUMENTS 1,514,271 A * 11/1924 Tilden ..... B02C 18/365 241/82.5
1,654,425 A * 12/1927 Marquis ..... B02C 18/365 241/82.5
1,673,229 A * 6/1928 Costa ..... B02C 18/302 241/82.5
1,683,679 A * 9/1928 Knowlton ..... B02C 18/302 241/82.5
1,695,898 A * 12/1928 Laemmel ..... B02C 18/365 241/298
2,281,258 A * 4/1942 Benton ..... B02C 18/365 241/82.2

(Continued)

FOREIGN PATENT DOCUMENTS

WO WO-2015140673 A1 * 9/2015 ..... A22C 17/0026

*Primary Examiner* — Faye Francis
(74) *Attorney, Agent, or Firm* — Westbridge IP LLC

(57) ABSTRACT

Disclosed is a meat grinder. According to the technical solution of this disclosure, food is placed into a processing cavity through a material inlet, and after the food is fallen to a side of a propeller away from a cutter head, the propeller is configure to propel the food to a cutter. The food is pressed against the cutter head and the food on the cutter head is cut by the cutter, and the food in discharge holes is squeeze outed by the propeller. Because the propeller is rotatably connected to the cutter head through the wear part, it may prevent an end of the propeller facing the cutter head from rubbing directly against the cutter head and causing black powder, so as to avoid the risk of contamination of the meat and affect the user's experience.

9 Claims, 3 Drawing Sheets

(56) References Cited

U.S. PATENT DOCUMENTS

| | | | | |
|---|---|---|---|---|
| 3,804,343 | A * | 4/1974 | Moffitt | B02C 18/302 241/82.5 |
| 5,289,979 | A * | 3/1994 | Lesar | B02C 18/302 241/82.6 |
| 10,682,650 | B2 * | 6/2020 | Joechner | B02C 18/302 |
| 11,203,022 | B2 * | 12/2021 | Wight | A22C 17/0026 |
| 2001/0052558 | A1 * | 12/2001 | Younker | B02C 18/365 241/82.1 |
| 2007/0090214 | A1 * | 4/2007 | Lesar | B02C 18/302 241/82.5 |
| 2015/0108259 | A1 * | 4/2015 | Metcalf | B02C 18/305 241/43 |
| 2016/0228880 | A1 * | 8/2016 | Norberg | B02C 18/305 |
| 2016/0236202 | A1 * | 8/2016 | Leonardi | B02C 18/301 |
| 2018/0071747 | A1 * | 3/2018 | Wight | B02C 18/301 |
| 2021/0291194 | A1 * | 9/2021 | Lewin | B02C 18/301 |

* cited by examiner

MEAT GRINDER

CROSS REFERENCE TO RELATED APPLICATIONS

This disclosure claims the benefit of Chinese Patent Application No. 202022570550.0, filed on Nov. 9, 2020 and entitled "Meat Grinder", the entirety of which is hereby incorporated herein by reference.

TECHNICAL FIELD

This disclosure relates to the technical field of household kitchen appliances, in particular to a meat grinder.

BACKGROUND

A meat grinder is to process raw meat into granular meat with different specifications according to different requirements, so as to be fully mixed with other auxiliary materials to meet the needs of the family. When working, the cutter shaft of the meat grinder rubs against the central hole of the cutter head to produce worn black powder, which makes the meat and water entering the central hole of the cutter head be mixed with the worn powder and squeezed out from the central hole, resulting in the risk of contamination of the meat with harmful substances.

SUMMARY

The main object of this disclosure is to provide a meat grinder, which aims to solve the problem that when working, the cutter shaft of the meat grinder rubs against the central hole of the cutter head to produce worn black powder, which makes the meat and water entering the central hole of the cutter head be mixed with the worn powder and squeezed out from the central hole, resulting in the risk of harmful substances in the meat.

In order to achieve the above object, this disclosure provides a meat grinder, which includes:

a housing, defining a processing cavity inside, a material inlet on a side wall, and a through opening at an end in a longitudinal direction, the through opening being in communication with the processing cavity;

a cutter head, covering on the through opening and defining discharge holes and a positioning hole, the discharge holes being in communication with the processing cavity;

a wear part, arranged in the positioning hole;

a propeller, arranged in the processing cavity, one end of the propeller being rotatably arranged on the wear part, the other end of the propeller being rotatably arranged on the housing, the material inlet being located on a propulsion path of the propeller; and a cutter, arranged on an end of the propeller facing the wear part.

In an embodiment, the propeller includes:

a spindle, one end of the spindle being rotatably arranged on the wear part, the other end of the spindle being rotatably arranged on the housing; and a spiral member, surrounding the spindle;

where, food is entered in the processing cavity through the material inlet, fallen to a side of the spindle away from the wear part, and propelled toward the cutter by the spiral member when the spindle rotates.

In an embodiment, the cutter includes:

a cutter body, defining a central hole, an end of the spindle facing the wear part being arranged in the central hole, extended to an outside of the central hole, and rotatably connected to the positioning hole; and blades, integrally formed or detachably arranged on an edge of the cutter body.

In an embodiment, the cutter body defines an avoiding notch at a side facing the cutter head, and an end of the wear part facing the cutter is attached to a side wall of the avoiding notch facing the cutter head.

In an embodiment, a surface of a side of the blades facing the cutter head is parallel to the side wall of the avoiding notch facing the cutter head.

In an embodiment, a side of the spindle facing the cutter head is provided with a special-shaped structure adapted to the central hole.

In an embodiment, an end of the special-shaped structure facing the cutter head is smaller than the side wall of the avoiding notch facing the cutter head.

In an embodiment, a distance between a peripheral wall of an end of the spindle facing the cutter head and a hole wall of the central hole of the wear part is 0 to 0.2 mm.

In an embodiment, the wear part is detachably connected to the positioning hole of the cutter head; or the cutter head and the wear part are integrally formed.

In an embodiment, an end of the propeller away from the cutter head is penetrated through the housing and is extended to form a transmission part in transmission connection with an external driving part.

According to the technical solution of this disclosure, food is placed into the processing cavity through the material inlet, and after the food is fallen to the side of the propeller away from the cutter head, the propeller is configure to propel the food to the cutter. The food is pressed against the cutter head and the food on the cutter head is cut by the cutter, and the food in the discharge holes is squeeze outed by the propeller. Because the propeller is rotatably connected to the cutter head through the wear part, it may prevent the end of the propeller facing the cutter head from rubbing directly against the cutter head and causing black powder, so as to avoid the risk of contamination of the meat and affect the user's experience.

BRIEF DESCRIPTION OF THE DRAWINGS

In order to more clearly describe the technical solutions in the embodiments of this disclosure or the related art, the following will briefly introduce the drawings that need to be used in the description of the embodiments or the related art. Obviously, the drawings in the following description are only some embodiments of this disclosure. For those of ordinary skill in the art, without creative work, other drawings can be obtained according to the structures shown in these drawings.

Figure 1:
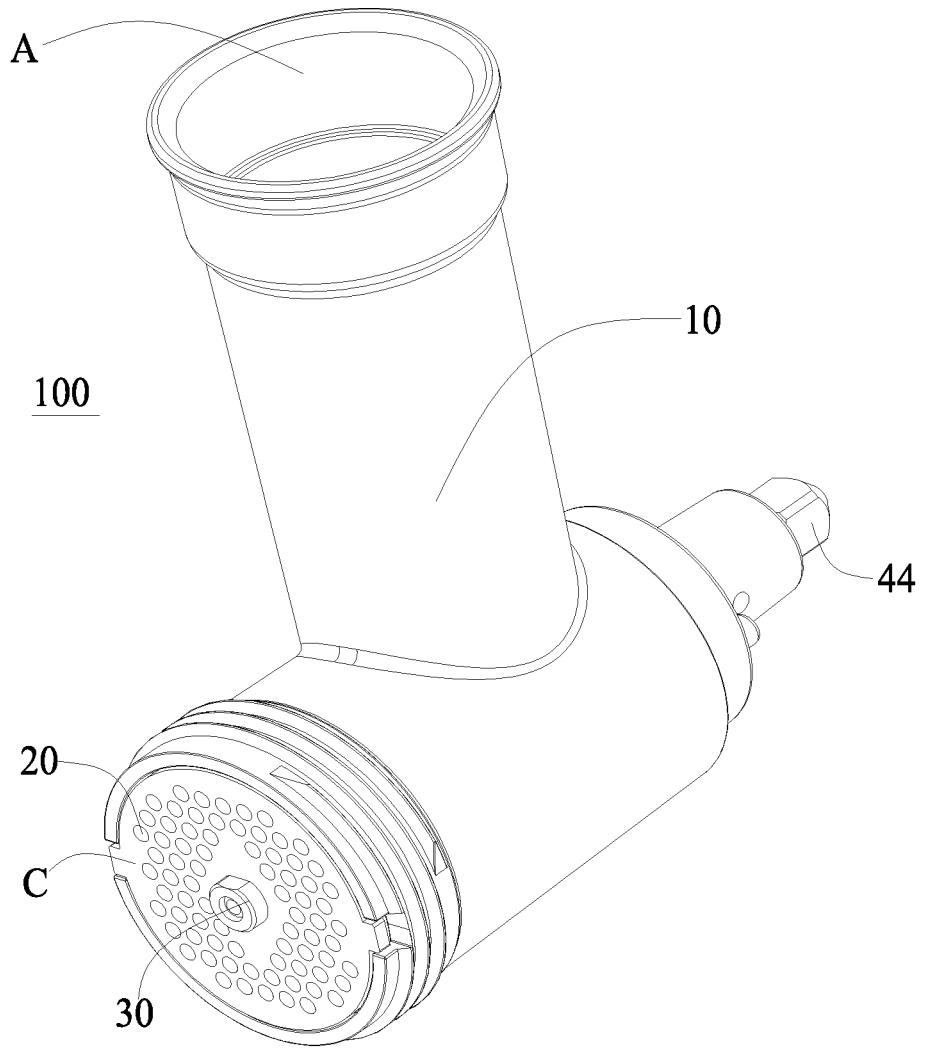
FIG. 1 is a schematic structural diagram of a meat grinder according to an embodiment of this disclosure.

The realization of the object of this disclosure, functional characteristics, and advantages will be further described in conjunction with the embodiments and with reference to the accompanying drawings.

DETAILED DESCRIPTION OF THE EMBODIMENTS

The technical solutions in the embodiments of this disclosure will be described clearly and completely in conjunction with the drawings in the embodiments of this disclosure. Obviously, the described embodiments are only a part of the embodiments of this disclosure, but not all the embodiments. Based on the embodiments in this disclosure, all other embodiments obtained by those of ordinary skill in the art without creative work shall fall within the protection scope of this disclosure.

It should be noted that all directional indicators (such as up, down, left, right, front, back . . . ) in the embodiments of this disclosure are only used to explain the relative positional relationship, movement conditions, etc. among the components in a specific posture (as shown in the drawings), if the specific posture changes, the directional indicator also changes accordingly.

In addition, the descriptions related to "first", "second", etc. in this disclosure are for descriptive purposes only, and cannot be understood as indicating or implying their relative importance or implicitly indicating the number of indicated technical features. Thus, the features defined as "first" and "second" may include at least one of the features either explicitly or implicitly. In addition, the technical solutions between the various embodiments can be combined with each other, but they must be based on the ability of those skilled in the art to realize. When the combination of technical solutions conflicts with each other or cannot be realized, it should be considered that the combination of such technical solutions does not exist, nor within the scope of protection required by this disclosure.

Figure 2:
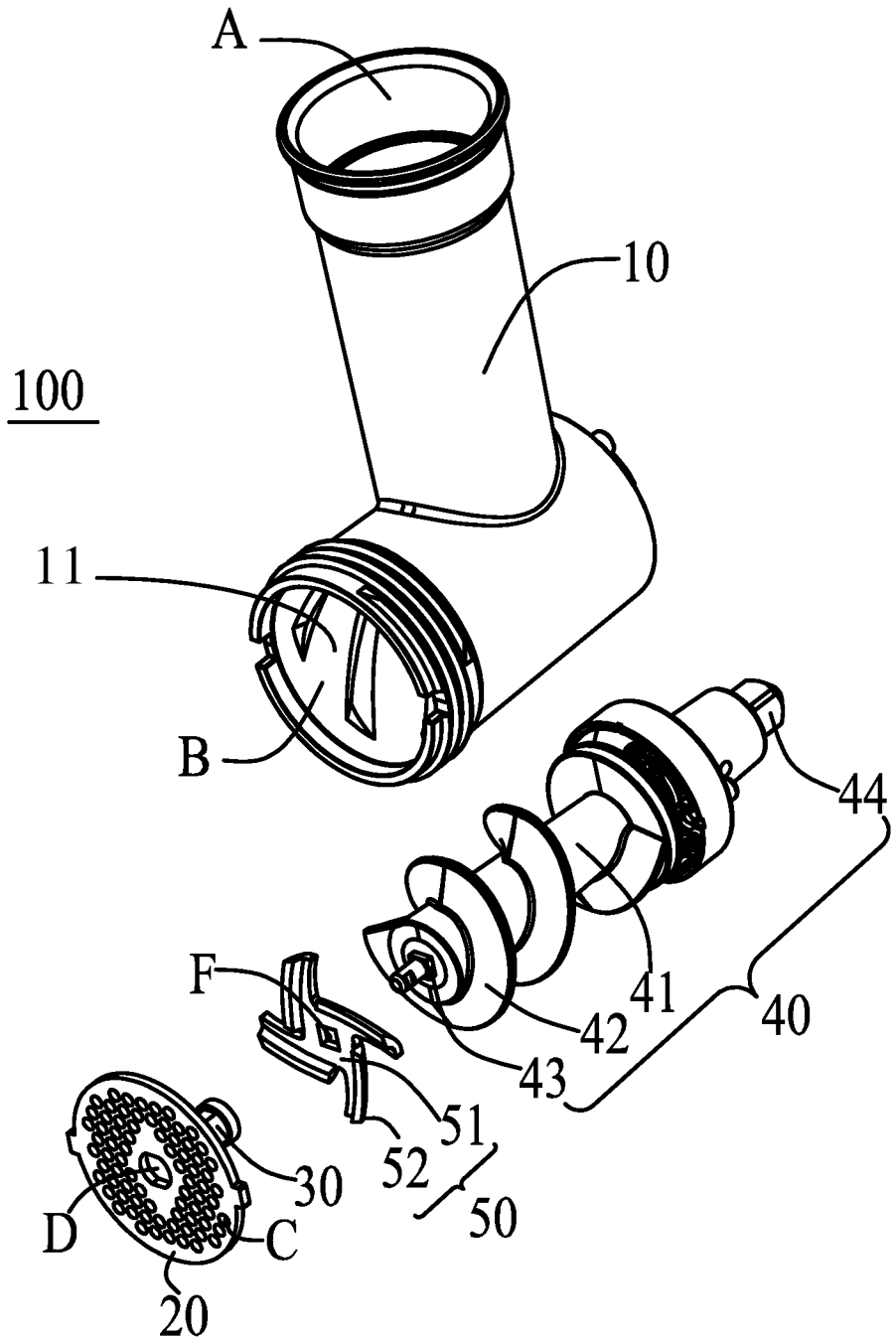
FIG. 2 is a schematic structural diagram of the meat grinder according to another embodiment of this disclosure.
Figure 3:
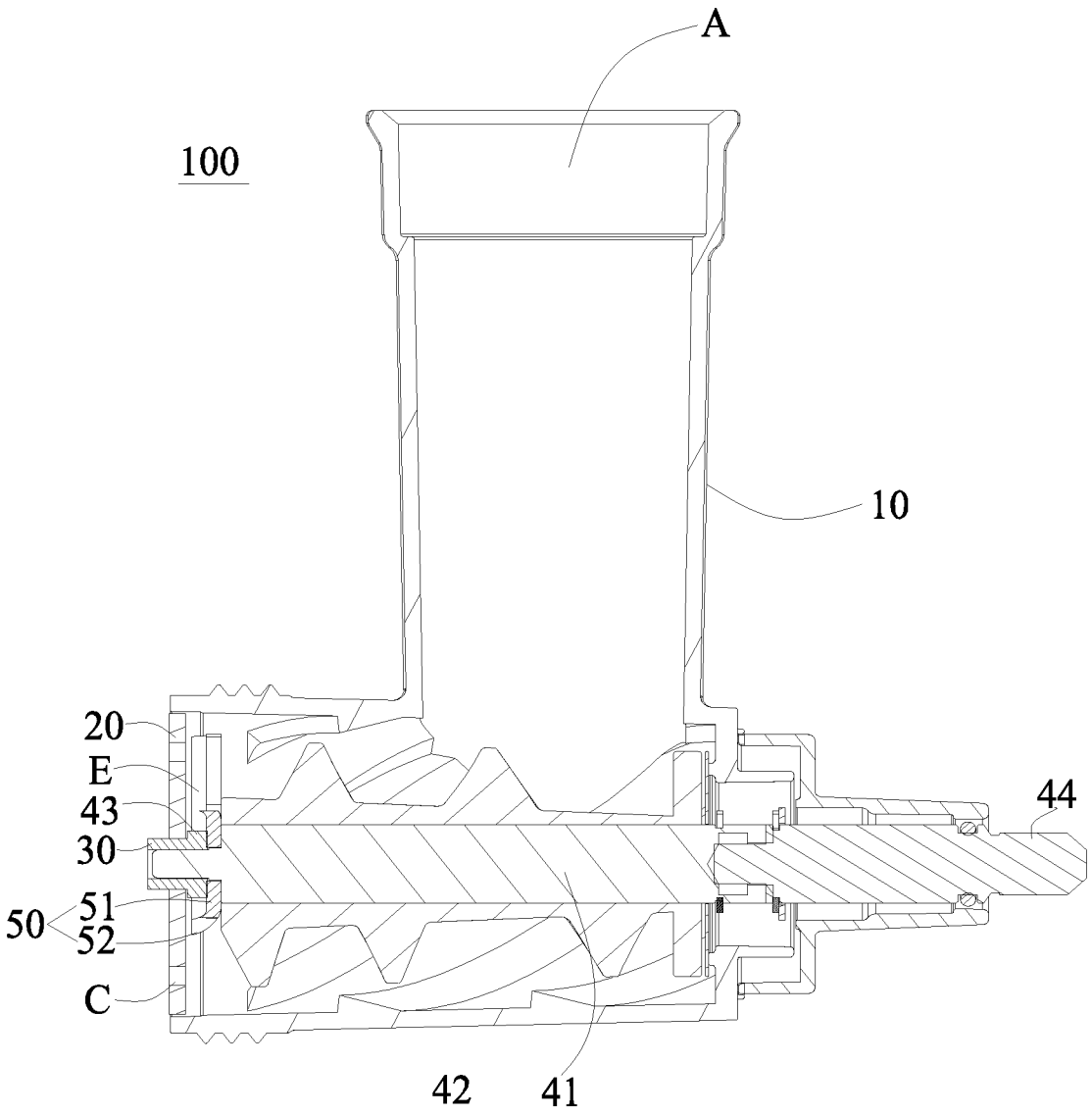
FIG. 3 is a schematic structural diagram of the meat grinder according to still another embodiment of this disclosure.

As shown in FIGS. 1 to 3, this disclosure provides a meat grinder 100, including: a housing 10, defining a processing cavity 11 inside, a material inlet A on a side wall, and a through opening B at an end in a longitudinal direction, the through opening B being in communication with the processing cavity 11; a cutter head 20, covering on the through opening B and defining discharge holes C and a positioning hole D, the discharge holes C being in communication with the processing cavity 11; a wear part 30, arranged in the positioning hole D; a propeller 40, arranged in the processing cavity 11, one end of the propeller 40 being rotatably arranged on the wear part 30, the other end of the propeller 40 being rotatably arranged on the housing 10, the material inlet A being located on a propulsion path of the propeller 40; and a cutter 50, arranged on an end of the propeller 40 facing the wear part 30.

In this embodiment, the housing 10 may be a three-way housing 10. The processing cavity 11 is defined inside the housing 10. The through opening B is defined at the end of the housing 10 in the longitudinal direction and is covered by the cutter head 20 with the discharge holes C. The cutter head 20 further defines the positioning hole D at the center, and the wear part 30 is arranged in the positioning hole D. Secondly, the propeller 40 is rotatably arranged in the housing 10, and one end of the propeller 40 is rotatably arranged on the wear part 30, and the other end of the propeller 40 is rotatably arranged on the housing 10. The material inlet A on the peripheral wall of the housing 10 is located on the side of the propeller 40 away from the cutter head 20. The cutter 50 is arranged on the side of the propeller 40 adjacent to the cutter head 20, and the cutter 50 may include blades. Food may be placed into the processing cavity 11 through the material inlet A, and after the food is fallen to the side of the propeller 40 away from the cutter head 20, the propeller 40 is configure to propel the food to the cutter 50. The food is pressed against the cutter head 20 and the food on the cutter head 20 is cut by the cutter 50, and the food in the discharge holes C is squeeze outed by the propeller 40. Because the propeller 40 is rotatably connected to the cutter head 20 through the wear part 30, it may prevent the end of the propeller 40 facing the cutter head 20 from rubbing directly against the cutter head 20 and causing black powder, so as to avoid the risk of contamination of the meat and affect the user's experience.

Specifically, the propeller 40 includes: a spindle 41, one end of the spindle 40 being rotatably arranged on the wear part 30, the other end of the spindle 40 being rotatably arranged on the housing 10; and a spiral member 42, surrounding the spindle 41; where, food is entered in the processing cavity 11 through the material inlet A, fallen to a side of the spindle 41 away from the wear part 30, and propelled toward the cutter 50 by the spiral member 42 when the spindle 41 rotates. In this embodiment, the propeller 40 may be a spiral propeller 40. Where, a spiral member is provided on the peripheral wall of the spindle 41. When the spindle 41 rotates, a propelling force may be generated. Food is entered in the processing cavity 11 through the material inlet A, fallen to a side of the spindle 41 away from the wear part 30, and propelled toward the cutter 50 by the spiral member 42 when the spindle 41 rotates.

Specifically, the cutter 50 includes: a cutter body 51, defining a central hole F, an end of the spindle 41 facing the wear part 30 being arranged in the central hole F, extended to an outside of the central hole F, and rotatably connected to the positioning hole D; and blades 52, integrally formed or detachably arranged on an edge of the cutter body 51. In this embodiment, in order to improve cutting efficiency, a central hole F may be defined on the cutter body 51, and the end of the spindle 41 facing the cutter head 20 is inserted into the central hole F to drive the cutter body 51 to rotate. The food is cut by the edge of the cutter body 51.

Specifically, the cutter body 51 defines an avoiding notch E at a side facing the cutter head 20, and an end of the wear part 30 facing the cutter 50 is attached to a side wall of the avoiding notch E facing the cutter head 20. In this embodiment, the end of the wear part 30 facing the cutter 50 is attached to the side wall of the avoiding notch E facing the cutter head 20 to form a closed space to prevent food from extruding from a gap between the spindle 41 and the hole wall of the central hole F.

Specifically, a surface of a side of the blades 52 facing the cutter head 20 is parallel to the side wall of the avoiding notch E facing the cutter head 20. In this embodiment, in order to facilitate the cutting of food, the surface of the blades 52 facing the cutter head 20 may be parallel to the side wall of the avoiding notch E facing the cutter head 20. When the food is squeezed into the discharge holes C, the surface of the blades 52 facing the cutter head 20 is parallel to the cutter head 20, so that the food may be quickly cut by the blades 52.

Specifically, a side of the spindle 41 facing the cutter head 20 is provided with a special-shaped structure 43 adapted to the central hole F. In this embodiment, in order to facilitate the rotation of the cutter 50, a special-shaped structure 43 may be formed on the side of the spindle 41 facing the cutter head 20. The special-shaped structure is configured as a transmission part. The central hole F is a non-circular hole, such as a square hole. The special-shaped structure 43 and the central hole F are adapted so as to transmit the torque of the spindle 41 to the cutter 50 to realize power transmission, so that the cutter 50 rotates, and the blades 52 and the discharge holes C on the cutter head 20 form a shearing effect.

Specifically, an end of the special-shaped structure 43 facing the cutter head 20 is smaller than the side wall of the avoiding notch E facing the cutter head 20. An end surface of an end of the special-shaped structure 43 facing the cutter head 20 is slightly lower than or flush with the side wall of the avoiding notch E facing the cutter head 20 in an axial direction. In this embodiment, in order to improve the installation stability of the cutter 50 and the special-shaped structure 43, an end of the special-shaped structure 43 facing the cutter head 20 is smaller than the side wall of the avoiding notch E facing the cutter head 20, and an end surface of an end of the special-shaped structure 43 facing the cutter head 20 is slightly lower than or flush with the side wall of the avoiding notch E facing the cutter head 20 in an axial direction, namely, a thickness of the special-shaped structure 43 in an axial direction is smaller than or equal to a length of the central hole F of the cutter body 51, so that the special-shaped structure 43 may be completely installed in the central hole F.

Specifically, a distance between a peripheral wall of an end of the spindle 41 facing the cutter head 20 and a hole wall of the central hole F of the wear part 30 is 0 to 0.2 mm. In this embodiment, in order to further improve the installation stability of the cutter 50 and the special-shaped structure 43, the distance between the peripheral wall of the end of the cutter head 20 and the hole wall of the central hole F is 0 to 0.2 mm.

Specifically, the wear part 30 and the positioning hole D are detachably connected; or, the cutter head 20 and the wear part 30 are integrally formed. In this embodiment, in order to improve the assembly stability between the cutter head 20 and the wear part 30, the wear part 30 may be in an interference fit or a screw connection with the positioning hole D, or the cutter head 20 and the wear part 30 may be integrally formed.

Specifically, an end of the propeller 40 away from the cutter head 20 is penetrated through the housing 10 and is extended to form a transmission part 44 in transmission connection with an external driving part. In this embodiment, in order to facilitate the connection of the meat grinder 100 with other external kitchen appliances, the end of the propeller 40 away from the cutter head 20 is penetrated through the housing 10 and is extended to form the transmission part 44 in transmission connection with the external driving part. The transmission part 44 on the propeller 40 is connected to the host of other kitchen appliances. Since different kitchen appliances have different output head structures, the transmission part 44 may be of any shape, and the main purpose of which is to transmit torsion force and realize the power transmission of the accessories.

The above are only the preferred embodiments of this disclosure, and therefore do not limit the patent scope of this disclosure. Under the conception of this disclosure, any equivalent structural transformation made by using the content of the description and drawings of this disclosure, or direct/indirect application in other related technical fields are all included in the patent protection scope of this disclosure.

What is claimed is:

1. A meat grinder, comprising:

a housing, defining a processing cavity inside, a material inlet on a side wall, and a through opening at an end in a longitudinal direction, the through opening being in communication with the processing cavity;

a cutter head, covering on the through opening and defining discharge holes and a positioning hole, the discharge holes being in communication with the processing cavity;

a wear part, arranged in the positioning hole;

a propeller, arranged in the processing cavity, one end of the propeller being rotatably arranged on the wear part, the other end of the propeller being rotatably arranged on the housing, the material inlet being located on a propulsion path of the propeller; and a cutter, arranged on an end of the propeller facing the wear part, wherein the propeller comprises:

a spindle, one end of the spindle being rotatably arranged on the wear part, the other end of the spindle being rotatably arranged on the housing; and a spiral member, surrounding the spindle;

wherein, food is entered in the processing cavity through the material inlet, fallen to a side of the spindle away from the wear part, and propelled toward the cutter by the spiral member when the spindle rotates, wherein the cutter comprises:

a cutter body, defining a central hole, an end of the spindle facing the wear part being arranged in the central hole, extended to an outside of the central hole, and rotatably connected to the positioning hole; and blades, integrally formed or detachably arranged on an edge of the cutter bod, wherein the cutter body defines an avoiding notch at a side facing the cutter head, and an end of the wear part facing the cutter is attached to a side wall of the avoiding notch facing the cutter head.

2. The meat grinder of claim 1, wherein a surface of a side of the blades facing the cutter head is parallel to the side wall of the avoiding notch facing the cutter head.

3. The meat grinder of claim 2, wherein a side of the spindle facing the cutter head is provided with a special-shaped structure adapted to the central hole.

4. The meat grinder of claim 3, wherein an end of the special-shaped structure facing the cutter head is smaller than the side wall of the avoiding notch facing the cutter head.

5. The meat grinder of claim 3, wherein an end surface of an end of the special-shaped structure facing the cutter head is lower than or flush with the side wall of the avoiding notch facing the cutter head in an axial direction.

6. The meat grinder of claim 3, wherein a thickness of the special-shaped structure in an axial direction is smaller than or equal to a length of the central hole of the cutter body.

7. The meat grinder of claim 1, wherein a distance between a peripheral wall of an end of the spindle facing the cutter head and a hole wall of the central hole of the wear part is 0 to 0.2 mm.

8. The meat grinder of claim 1, wherein the wear part is detachably connected to the positioning hole of the cutter head; or the cutter head and the wear part are integrally formed.

9. The meat grinder of claim 1, wherein an end of the propeller away from the cutter head is penetrated through the housing and is extended to form a transmission part in transmission connection with an external driving part.

* * * * *